US010639902B2

(12) United States Patent
Hollands et al.

(10) Patent No.: US 10,639,902 B2
(45) Date of Patent: May 5, 2020

(54) INKJET PRINTHEAD

(71) Applicant: Canon Production Printing Netherlands B.V., Venlo (NL)

(72) Inventors: Peter J. Hollands, Venlo (NL); Marco T. R. Moens, Venlo (NL)

(73) Assignee: Canon Production Printing Netherlands B.V., Venlo (NL)

( * ) Notice: Subject to any disclaimer, the term of this patent is extended or adjusted under 35 U.S.C. 154(b) by 0 days.

(21) Appl. No.: 16/060,589

(22) PCT Filed: Dec. 13, 2016

(86) PCT No.: PCT/EP2016/080767

§ 371 (c)(1),
(2) Date: Jun. 8, 2018

(87) PCT Pub. No.: WO2017/108499

PCT Pub. Date: Jun. 29, 2017

(65) Prior Publication Data

US 2019/0210374 A1 Jul. 11, 2019

(30) Foreign Application Priority Data

Dec. 23, 2015 (EP) ..... 15202313
Feb. 23, 2016 (EP) ..... 16156811

(51) Int. Cl.
*B41J 2/175* (2006.01)
*B41J 2/14* (2006.01)

(52) U.S. Cl.
CPC ..... *B41J 2/17563* (2013.01); *B41J 2/14145* (2013.01); *B41J 2/14201* (2013.01);
(Continued)

(58) Field of Classification Search
CPC ..... B41J 2/17563; B41J 2/14201; B41J 2/14145; B41J 2002/14403; B41J 2002/14306; B41J 2202/12
See application file for complete search history.

(56) References Cited

U.S. PATENT DOCUMENTS 6,969,158 B2 * 11/2005 Taira ..... B41J 2/14209 347/40
7,722,178 B2 * 5/2010 Taira ..... B41J 2/14024 347/71

(Continued)

FOREIGN PATENT DOCUMENTS

JP 2007-290376 * 11/2007 ..... B41J 2/045
JP 4640367 * 3/2011 ..... B41J 2/045
WO 2014007814 A1 1/2014

*Primary Examiner* — Huan H Tran
(74) *Attorney, Agent, or Firm* — The Webb Law Firm

(57) ABSTRACT

An inkjet print head includes an ink supply substrate having an ink supply channel in fluid communication with an ink supply connector channel for receiving ink from an ink reservoir and in fluid communication with an ink return connector channel for supplying ink to the ink reservoir; a droplet forming unit arranged on the ink supply substrate and having an ink inlet surface, in which ink inlet surface an ink inlet port for receiving ink from the ink supply substrate is arranged; a manifold chamber formed over the ink inlet surface of the droplet forming unit; and a filter arranged between the ink supply substrate and droplet forming unit. The filter has a first filter surface at an upstream side and a second filter surface at a downstream side. Filter holes extend from the first filter surface to the second filter surface. The first filter surface forms a wall of the ink supply channel.

14 Claims, 5 Drawing Sheets

(52) U.S. Cl.
CPC ..... *B41J 2002/14306* (2013.01); *B41J 2002/14403* (2013.01); *B41J 2202/12* (2013.01)

(56) References Cited

U.S. PATENT DOCUMENTS

| | | | | |
|---|---|---|---|---|
| 9,283,590 | B2 * | 3/2016 | Govyadinov | B41J 2/175 |
| 2007/0229635 | A1 * | 10/2007 | Taira | B41J 2/14024 347/93 |
| 2009/0284572 | A1 | 11/2009 | Katoh | |
| 2010/0073433 | A1 | 3/2010 | Shimizu et al. | |
| 2010/0328409 | A1 | 12/2010 | Matsufuji et al. | |
| 2014/0078224 | A1 | 3/2014 | Park et al. | |
| 2017/0182775 | A1 * | 6/2017 | Hollands | B41J 2/14201 |
| 2017/0182785 | A1 * | 6/2017 | Hollands | B41J 2/14201 |
| 2018/0370235 | A1 * | 12/2018 | Hollands | B41J 2/14233 |

* cited by examiner

INKJET PRINTHEAD

CROSS-REFERENCE TO RELATED APPLICATIONS

This application is the United States national phase of International Application No. PCT/EP2016/080767 filed Dec. 13, 2016, and claims priority to European Patent Application Nos. 15202313.1 and 16156811.8 filed Dec. 23, 2015, and Feb. 23, 2016, respectively, the disclosures of which are hereby incorporated in their entirety by reference.

BACKGROUND OF THE INVENTION

Field of the Invention

The present invention generally pertains to an inkjet print head.

Description of Related Art

Multiple kinds of inkjet print heads are well known in the art. In one kind of inkjet print head, a continuous flow of ink is circulated from an ink reservoir through the inkjet print head and back to the reservoir. Such ink circulation enables removal of debris and/or gas bubbles from the print head. US 2009/0284572 A1 discloses such a print head. Further, it is known to use a lithographically manufactured substrate for forming very small fluidic structures enabling high-frequency operation for expelling very small droplets allowing image forming on a recording substrate with a very high resolution. A disadvantage of such very small structures is found in very small particles being able to enter the fluidic structures and blocking the fluid flow or disrupting the droplet formation in any other way. So, it is preferred to prevent such small particles from entering the lithographically manufactured structure.

US 2009/0284572 A1 discloses that it is not preferable to include a filter in an ink circulation path. In particular, it is disclosed that air bubbles are blocked by the filter preventing the air bubbles from being transported back to the ink reservoir, where they can disappear from the ink. Moreover, in the embodiment illustrated in FIG. 30 of US 2009/0284572 A1, it will be hard, if not impossible, to purge the air bubbles together with the ink through the nozzles. Hence, it is suggested not to apply a filter in an ink circulation path in the print head and, consequently, debris being circulated may eventually enter the lithographically manufactured fluidic structures It is an object of the present invention to provide an inkjet print head with a continuous flow through the print head, wherein it is prevented that circulating debris may enter fluidic structures of a droplet forming unit.

SUMMARY OF THE INVENTION

The present invention relates to an inkjet print head for generating a droplet of ink. The inkjet print head comprises an ink supply substrate having an ink supply channel fluidly connected to an ink supply connector channel for receiving ink from an ink reservoir and fluidly connected to an ink return connector channel for supplying ink to the ink reservoir. The inkjet print head further comprises a droplet forming unit arranged on the ink supply substrate, wherein the droplet forming unit has an ink inlet surface and comprising a number of droplet ejection units, each droplet ejection unit comprising an ink flow path extending between an ink inlet port and an orifice, a piezoelectric actuator being arranged in operative communication with the ink flow path for generating a pressure wave in the ink in the ink flow path, the ink inlet port for receiving ink from the ink supply substrate being arranged in the ink inlet surface. Further, the inkjet print head comprises a manifold chamber formed over the ink inlet surface of the droplet forming unit and a filter arranged between the ink supply substrate and the droplet forming unit. The filter has a first filter surface at an upstream side and a second filter surface at a downstream side, the second filter surface being opposite to the first filter surface and filter holes extending from the first filter surface to the second filter surface. The first filter surface forms a wall of the ink supply channel.

In the inkjet print head according to the present invention, the ink may be continuously flowed through the ink supply substrate. An ink supply channel formed in the ink supply substrate runs from an ink supply connector channel, where ink may be received from an ink reservoir, to an ink return connector channel, where ink may be supplied back to the ink reservoir.

A wall of the ink supply channel is formed by the first surface of the filter. Any fluidic structure downstream of the second surface of the filter is not part of the circulation path and ink downstream of the filter is not circulated, while the first filter surface is continuously flown with ink preventing debris sticking on the filter surface and thereby eventually blocking the filter. The ink downstream of the second surface of the filter will be transported through the manifold chamber, into the droplet forming unit and will be expelled in droplets through a nozzle orifice of the droplet forming unit.

In view of the direction of flow downstream of the second surface of the filter, any air bubbles at the second surface of the filter will be transported into the manifold chamber, clearing the filter. From the manifold chamber, which has the ink inlet surface of the droplet forming unit as a wall, the air bubbles may easily be removed by a suitable purge action. In particular, the air bubbles may coagulate to a large air bubble and only a small amount of ink needs to be purged for removing the air bubble.

In an embodiment, the inkjet print head is provided with a manifold supply channel surrounding the manifold chamber for supplying ink to the manifold chamber, wherein the second filter surface forms a wall of the manifold supply channel. In this embodiment, the manifold supply channel is arranged between the second filter surface and the manifold chamber. The manifold supply channel surrounds the manifold chamber such that ink may enter the manifold chamber from multiple sides. Thereby, any air bubbles are pushed into the manifold chamber from those multiple sides and the air bubbles cannot escape the manifold chamber, once they have entered the manifold chamber. Moreover, when a purge pressure is provided through the ink supply channel, the purge pressure will be transported through the manifold supply channel and through the multiple sides to the manifold chamber. Then, any air bubbles will be pressed and squeezed through the droplet forming unit through a nozzle orifice.

In an embodiment, the manifold supply channel is formed in an intermediate element, the intermediate element being arranged between the ink supply substrate and the droplet forming unit. An intermediate element is a suitable and effective means for providing for the manifold supply channel. Moreover, in a further embodiment, the intermediate element is provided with an ink supply opening and the ink supply opening forms the manifold chamber. Hence, the intermediate element may provide for both manifold chamber and manifold supply channel. In an even further embodiment, the intermediate element is provided with support protrusions at a circumference of the manifold supply channel. Thus, the manifold chamber and the manifold supply channel are separated by the support protrusions. A fluid connection between the manifold chamber and the manifold supply channel is then formed by at least one manifold feed opening arranged between the support protrusions. The support protrusion may ensure a fixed distance to the ink supply substrate and thus ensure a fixed cross-section of the manifold supply channel, for example.

In an embodiment, the inkjet print head according to the present invention is provided with the manifold chamber having a flexible wall arranged opposite to the ink inlet surface of the droplet forming unit. The flexible wall may be formed by a flexible foil arranged over the manifold chamber.

For example, if the manifold chamber is formed in an intermediate element, as provided in the above-described embodiment, the flexible foil may be arranged over the intermediate element. Moreover, in such embodiment, the flexible foil may extend over the manifold supply channel; and the flexible foil may be provided with filter holes in an area arranged over the manifold supply channel. Thus, the flexible foil may form the filter.

In an embodiment, the distance between the droplet forming unit and the flexible wall is smaller than 1 mm, preferably smaller than 500 micron and more preferably smaller than 400 micron. The small distance between the flexible wall and the ink inlet surface provides for suppression of cross-talk through the manifold. Further, the small distance results in the manifold chamber having a relatively small volume and provides for any air bubbles being close to the ink inlet surface of the droplet forming unit. The small volume and the air bubbles close to the ink inlet surface ensure that only little ink needs to be purged for removing air bubbles downstream of the filter.

In an embodiment of the present invention, the filter comprises a number of filter holes in a filter area, each filter hole having a filter hole area and the filter having a cumulative filter hole area equaling the filter hole area times the number of filter holes; and a ratio of the cumulative filter hole area over the filter area being selected such that a flow of ink in the ink supply channel in a direction parallel to the first filter surface generates a parallel ink flow in the ink at the second filter surface. Thus, any air bubbles that remain floating against the second surface of the filter will be transported along the second surface of the filter with the flow generated by the continuous flow over the first surface. In particular, said ratio is at least 15%, preferably at least 20% and more preferably at least 30%. It is noted that this embodiment may be even more effective in combination with a small volume of ink downstream of the second surface of the filter, e.g. in a manifold supply channel, and/or a small volume in the manifold chamber.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE INVENTION

Figure 1A:
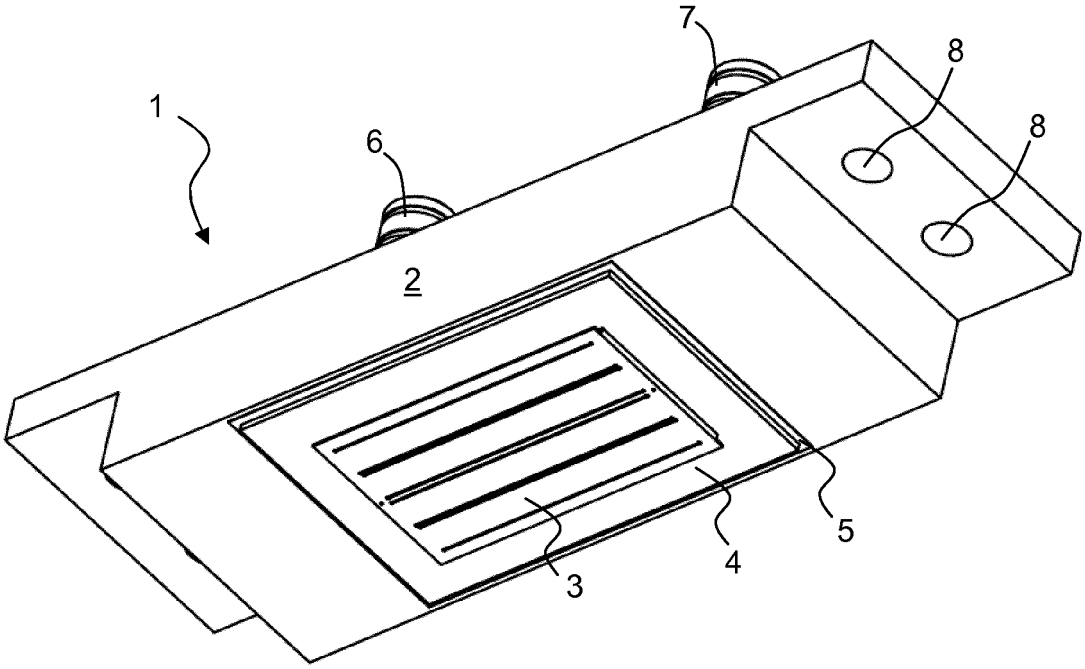
FIG. 1A shows a perspective view of an embodiment of an inkjet print head.

The present invention will now be described with reference to the accompanying drawings, wherein the same reference numerals have been used to identify the same or similar elements throughout the several views.

Figure 1B:
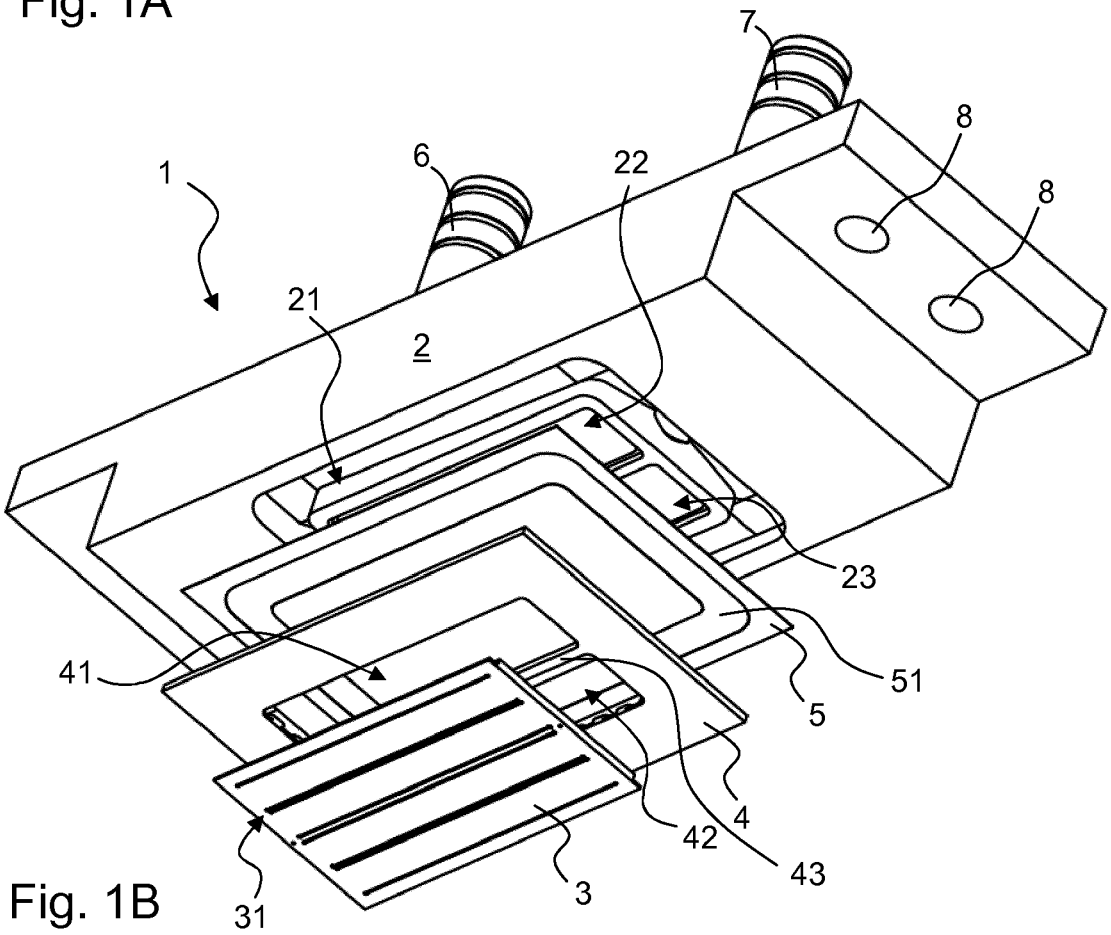
FIG. 1B shows an exploded perspective view of the embodiment according to FIG. 1A.

FIGS. 1A and 1B illustrate an inkjet print head 1 comprising an ink supply substrate 2 and a droplet forming unit 3. An intermediate element 4 and a flexible foil 5 are interposed between the ink supply substrate 2 and the droplet forming unit 3. In this embodiment, the ink supply substrate 2 is provided with two ink connectors, in particular an ink supply connector 6 and an ink return connector 7 enabling a continuous flow of ink through the inkjet print head 1 as elucidated hereinafter in more detail. The ink supply substrate 2 is provided with a suitable number of suitable mounting means, which mounting means are embodied in the illustrated print head as mounting holes 8. Any other kind of mounting means may be employed alternatively or additionally.

In this particular example, the droplet forming unit 3 is embodied as a MEMS (Micro-Electro-Mechanical System) chip constructed from an etchable material such as silicon, in which micro structures, such as ink channels (i.e. ink flow paths), are etched. The ink channels extend between an ink inlet port and an orifice. Further, piezo-electric actuators are provided for generating a pressure wave in the ink channels, wherein the pressure waves are such that a droplet of ink is ejected from the orifice. Such structures and corresponding actuators for generating droplets are well known in the art and are not elucidated herein in more detail. It is noted that for the present invention, the droplet forming unit may be formed from any suitable materials using any suitable processing as apparent to those skilled in the art.

The ink supply substrate 2 may be formed from any suitable material. For example, a graphite element may be milled and/or drilled and/or laser ablated to form ink supply structures in the ink supply substrate. As another example, suitable plastics may be used to form the ink supply substrate 2 as well. In particular, the intermediate element 4 and the flexible foil 5 thermally isolate the droplet forming unit 3 from the ink supply substrate 2. Selecting suitable materials and/or shape of the intermediate element 4 enables to provide for design freedom for the ink supply substrate 2 as further elucidated hereinafter.

Referring in particular to FIG. 1B, the droplet forming unit 3 is provided with a number of orifices 31, commonly arranged in a number of rows, wherein the orifices 31 are arranged in a nozzle surface 33 of the droplet forming unit 3. In an ink inlet surface 34 (not shown in FIG. 1B) opposite to the nozzle surface 33, ink inlet ports 32 (not shown in FIG. 1B) are provided. Ink is supplied to the ink inlet ports 32 through the intermediate element 4, which comprises thereto an ink supply opening. More in particular, in the illustrated embodiment, the ink supply opening is divided in two ink supply openings 41, 42 with a support ridge 43 provided therebetween.

The flexible foil 5 is arranged, compared to the droplet forming unit 3, at an opposing surface of the intermediate element 4. The flexible foil 5, the ink supply openings 41, 42 and the droplet forming unit 3 together enclose and form a manifold chamber. The flexible foil 5 has a suitable flexibility for absorbing any pressure waves generated in the ink channels of the droplet forming unit 3 and propagating into the manifold chamber. Such pressure waves are absorbed by the flexible foil 5 thereby preventing cross-talk between different ink channels in the droplet forming unit 3 and thus forming a damper. In order for the flexible foil 5 to function properly as a damper, a distance between the droplet forming unit 3 and the flexible foil 5 needs to be relatively small to prevent that the inertia of the ink in the manifold chamber prevents that the pressure wave arrives at the flexible foil 5. Therefore, a distance between the droplet forming unit 3 and the flexible foil 5 is preferably smaller than 1 mm, more preferably smaller than 500 micron and even more preferably smaller than 400 micron. Of course, too small might lead to insufficient ink supply.

The flexible foil 5 is further provided with a filter area 51, which is, in this embodiment, arranged at a circumference of the ink supply openings 41, 42 in the intermediate element 4. Ink is thus supplied to the manifold chamber through the filter area 51. The filter area 51 may be formed by providing an array of filter holes in the flexible foil 5, for example, wherein the filter holes are made with a predetermined filter hole diameter in order to prevent particles of a predetermined size larger than said diameter to pass through the filter. In another embodiment, a mesh of a woven or a non-woven material may be provided in the filter area 51 instead of the flexible foil 5. If no filter is desired, the filter area 51 may be replaced by an ink supply area having holes of a larger diameter or the flexible foil 5 may be omitted in the filter area 51.

In the ink supply substrate 2, at the location of the filter area 51, an ink supply channel 21 is provided. The ink supply channel 21 is in fluid communication with the ink supply connector 6 and the ink return connector 7. Through the ink supply connector 6 ink is supplied to the ink supply channel 21, where the ink may flow through the filter area 51 into the manifold chamber or the ink may flow to the ink return connector 7 and return to an ink reservoir, depending inter alia on the amount of ink ejected from the droplet forming unit 3.

The ink supply substrate 2 is further provided with a damper recess. In the illustrated embodiment, the damper recess is divided in a first damper recess 22 and a second damper recess 23 corresponding to the ink supply openings 41, 42 in the intermediate element 4. The damper recesses 22, 23 allow the flexible foil 5 to move and thus to absorb the pressure waves.

Figure 2A:
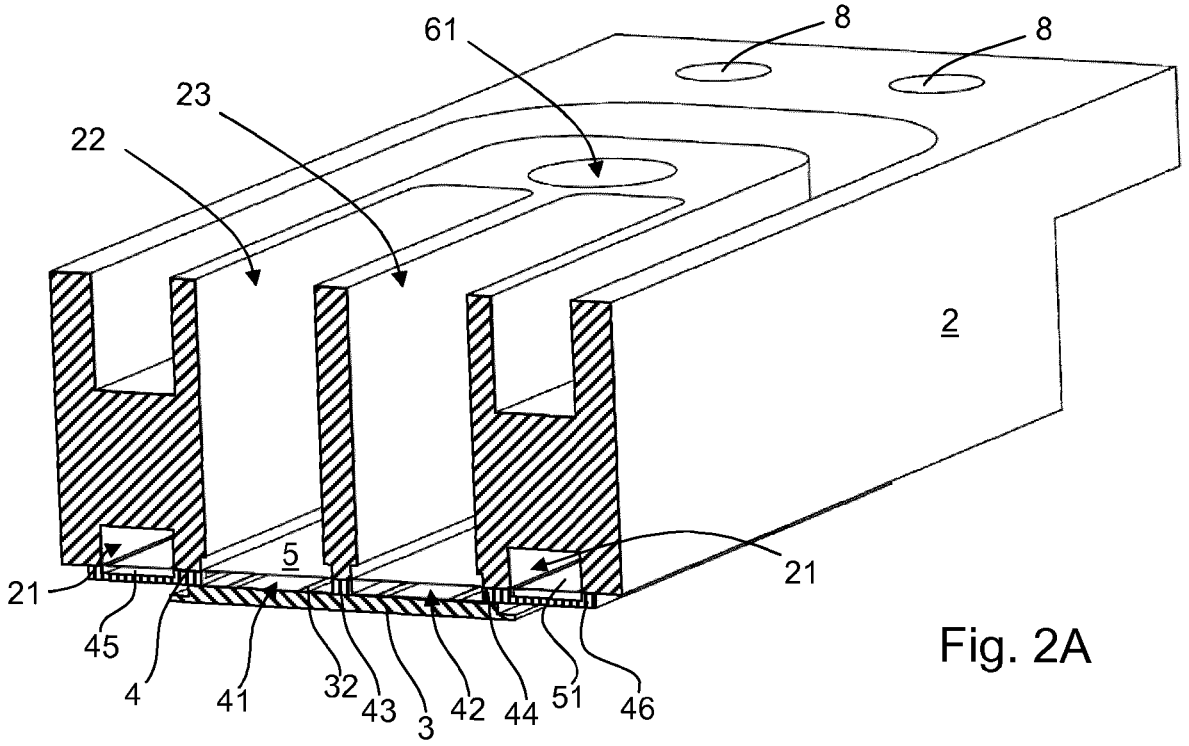
FIG. 2A shows a cross-section of a part of the embodiment of FIG. 1A in a perspective view.

FIGS. 2A-2D provide a number of cross-sectional perspective views for further illustrating the structure of and ink flow in the inkjet print head 1. FIG. 2A shows the ink supply substrate 2 having an ink supply connector channel 61 providing for a fluid connection between the ink supply connector 6 and the ink supply channel 21. Ink provided through the ink supply connector 6 flows through the ink supply connector channel 61 into the ink supply channel 21.

As shown in FIG. 2A, the damper recesses 22, 23 extend through the ink supply substrate 2. This provides for the flexible damper foil 5 never being loaded due to atmospheric pressure changes, which could decrease the compliance of the flexible foil 5. Any other arrangement providing for atmospheric pressure at the outer side (side opposite of the side of the flexible foil 5 forming a flexible wall of the manifold chamber) may be employed as well.

Figure 2D:
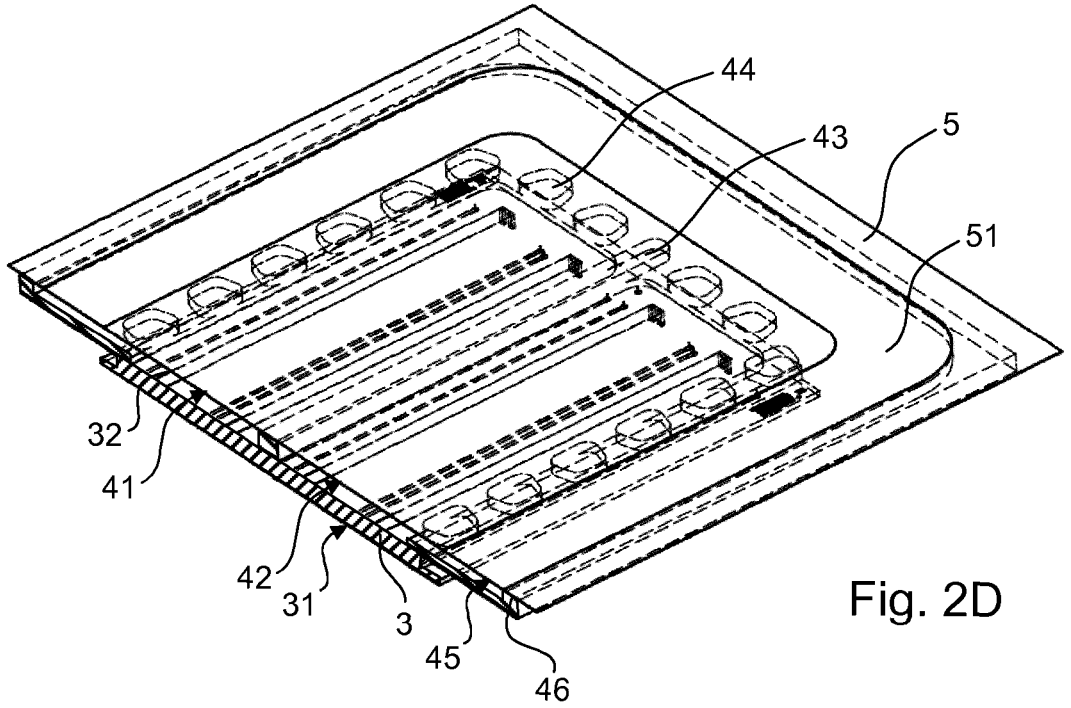
FIG. 2D shows a cross-section of the part of FIG. 2C in another perspective view.
Figure 2B:
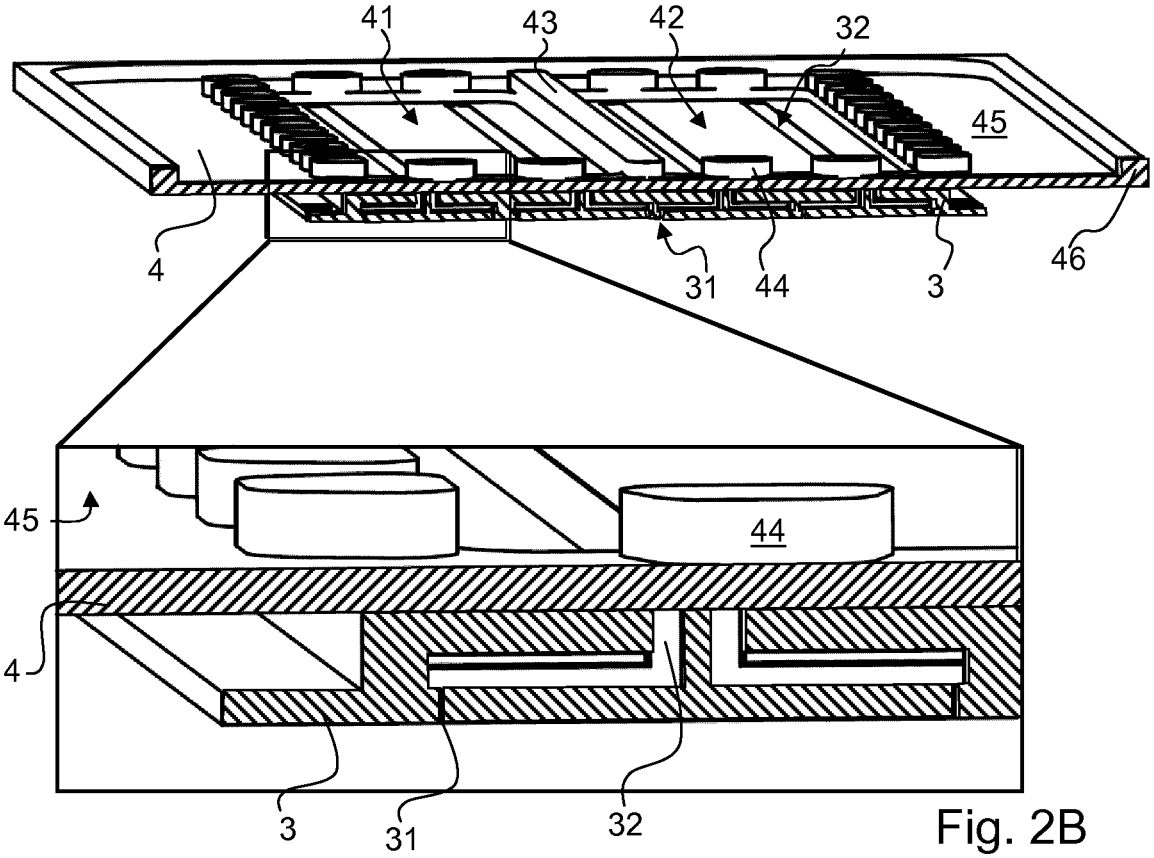
FIG. 2B shows a cross-section of a part of the embodiment of FIG. 1A in a perspective view, including an enlarged section.

The intermediate element 4 and the droplet forming unit 3 are better illustrated in FIG. 2B. The droplet forming unit 3 is illustrated in cross-section, showing the ink channels including the orifice 31 and the ink inlet port 32 in the nozzle surface 33 and the ink inlet surface 34, respectively. The droplet forming unit 3 is arranged on the intermediate element 4 on an outer portion 35 of the ink inlet surface 34. The outer portion 35 of the ink inlet surface 34 is a surface portion where no ink inlet ports 32 are arranged, while said surface portion surrounds the ink inlet ports 32. A surface of the intermediate element 4 on which the droplet forming unit 3 is arranged is substantially flat, except for the ink supply openings 41, 42. An opposite surface of the intermediate element 4 is provided with an edge ridge 46, support protrusions 44, a manifold supply channel 45 and the support ridge 43. Manifold feed openings 47 are provided between the support protrusions 44.

Figure 2C:
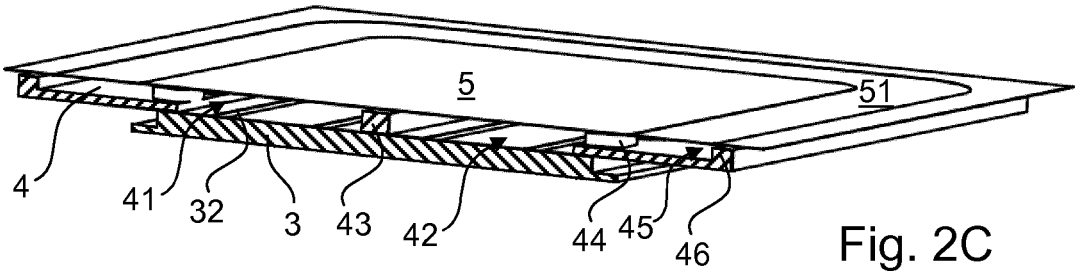
FIG. 2C shows a cross-section of a part of the embodiment of FIG. 1A in a perspective view.

Referring to FIGS. 2C and 2D, the flexible foil 5 is arranged on the edge ridge 46, the support ridge 43 and the support protrusions 44. The filter area 51 is arranged over the manifold supply channel 45. Thus, ink is supplied through the filter area 51 and flows into the manifold supply channel 45. The ink then flows between the support protrusions 44 from all sides into the manifold chamber formed by the supply openings 41, 42.

Figure 3A:
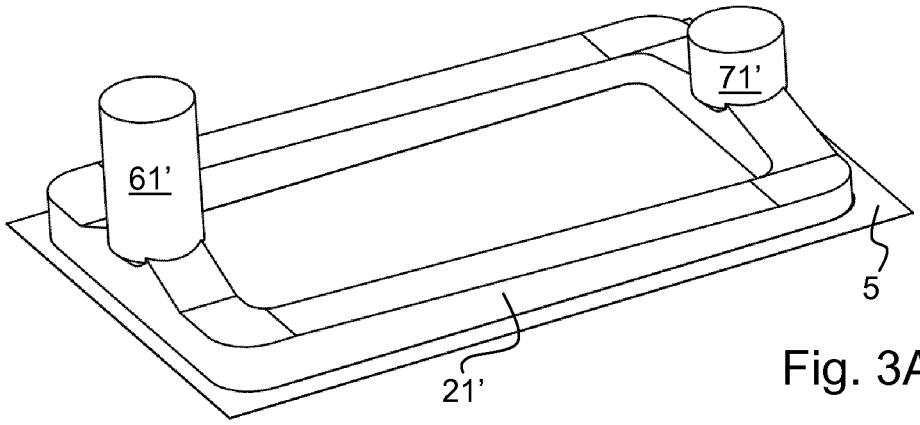
FIG. 3A shows a perspective view of an ink flow path in a part of the embodiment of FIG. 1A.

In FIG. 3A-3D, the ink flow is further illustrated. Referring to FIG. 3A, the flexible foil 5 is shown. Further, the ink supply channel ink 21', i.e. the ink in the ink supply channel 21, is shown. Similarly, the ink supply connector channel ink 61', i.e. the ink in the ink supply connector channel 61, and the ink return connector channel ink 71', i.e. the ink in an ink return connector channel (not shown), are shown. The ink may continuously flow from the ink supply connector 6 through the ink supply channel 21 over the filter area 51 to the ink return connector 7. Any dirt or other particles in the ink as supplied and large enough to cause obstructions in the droplet forming unit 3 may thus be prevented from entering the droplet forming unit 3. Since the filter area 51 is arranged so close to the droplet forming unit 3, a chance that a too large particle gets into the ink in the manifold chamber and into the droplet forming unit 3 is made as small as possible.

Figure 3B:
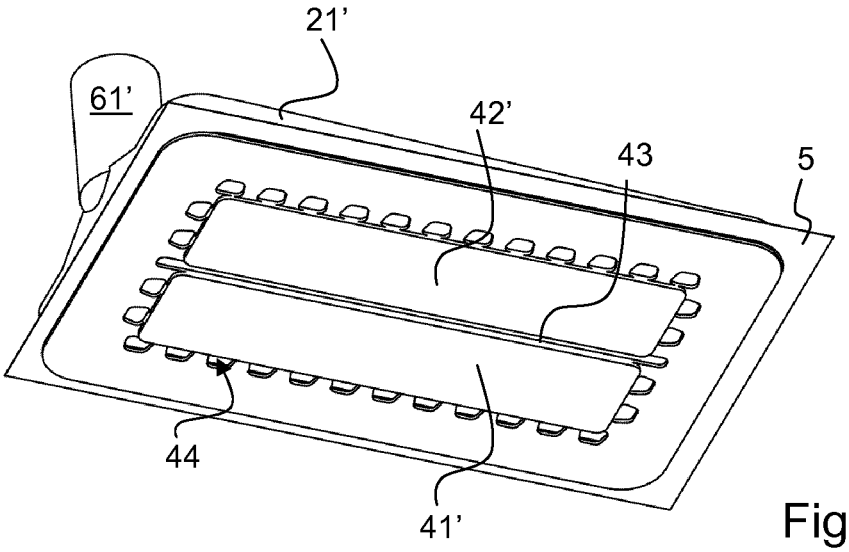
FIG. 3B shows another perspective view of the ink flow path shown in FIG. 3A.

FIG. 3B shows a similar view, but then from the other side of the flexible foil 5. The manifold supply channel ink 45' flows from all sides around the protrusions 44 into the manifold chamber forming the manifold ink 41' and 42'. The support ridge 43 divides the manifold chamber in the two sections 41 and 42. The ink flowing from all sides ensures that there are no dead zones where ink may remain. Ink staying and not being refreshed will eventually result in deterioration due to aging. Aged ink may result in dried ink particles and other potential obstructions and disturbances. Preventing dead zones prevents these kinds of potential problems.

Further, the ink flowing from all sides of the circumference of the manifold chamber into the manifold chamber ensures that any air bubbles downstream of the filter area 51 are transported towards the droplet forming unit 3. Therefore, when applying a purge pressure pulse, i.e. an increased pressure pulse through the ink supply connector 6, purging a relatively large amount of ink through the droplet forming unit 3, the air bubbles will be transported through the droplet forming unit ink channels and through the orifices 31 outwards.

In more detail, the filter area 51 may be provided with filter holes covering about 30% of the filter area 51. In a particular embodiment, the filter holes may have a diameter of about 18 micron at a pitch of about 30 micron and arranged in staggered rows. Taking into account the relatively large filter area 51, which also greatly reduces a flow resistance of the filter, it has been observed that a rinsing action through the ink supply channel 21 induces a flow in the manifold supply channel 45 and even in the ink supply openings 41, 42. Air bubbles in the manifold supply channel 45 and in the ink supply openings 41, 42 (the manifold chamber) are observed to flow towards the ink return connector 7, but these air bubbles do not pass through the filter holes in the filter area 51. Still, such a flow below the filter holes apparently enables to move air bubbles that tend to float against the filter, which allows to subsequently purge these air bubbles through the channels of the droplet forming unit 3. It is noted that the amount of flow generated below the filter depends inter alia also on the amount of ink below the filter. Since in the illustrated embodiment only a thin layer of ink is present, a significant flow may be generated.

Figure 4A:
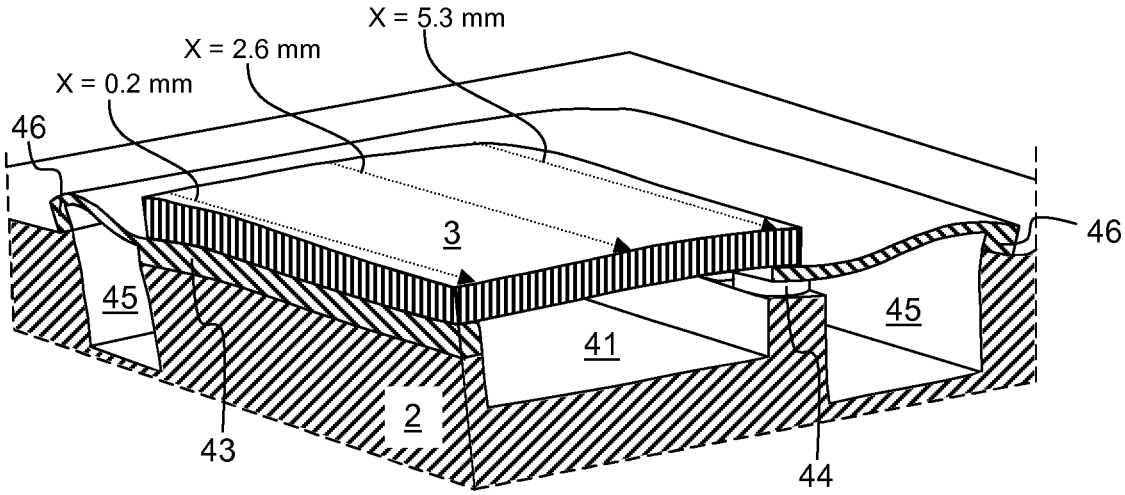
FIG. 4A shows a cross-section of a deformed part of a simulated embodiment of an inkjet print head.
Figure 4B:
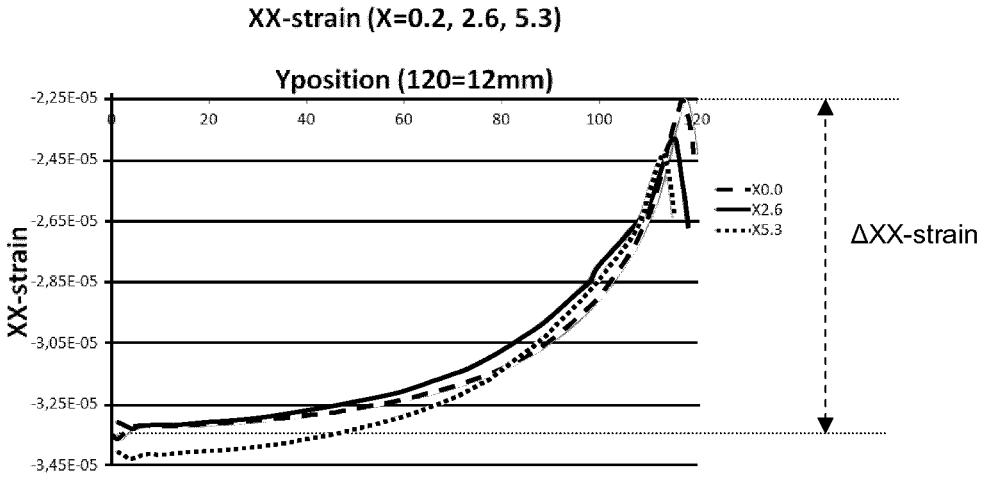
FIGS. 4B and 4C each show a graph representing an amount of deformation corresponding to the view shown in FIG. 4A.
Figure 4C:
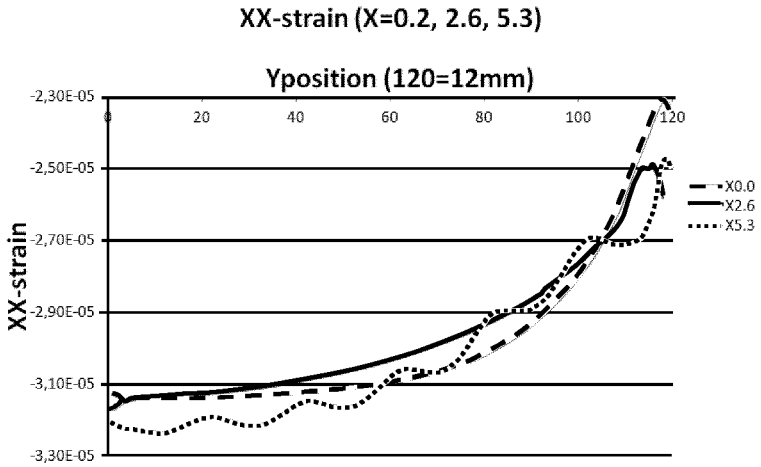

FIG. 4A-4C illustrate simulation results for an assembly of an ink supply substrate 2, an intermediate element 4 and a droplet forming unit 3. In the simulation, the droplet forming unit 3 is presumed to be made of silicon and the intermediate element 4 and the ink supply substrate 2 are made of graphite. The simulated assembly is bonded during manufacturing at an elevated temperature and then cooled. Due to differences in the coefficient of thermal expansion, the silicon and graphite shrink in differing amounts, resulting in a mismatch of dimensions, as is well known in the art. The mismatch in dimensions results in mechanical stress and deformations as is readily apparent from FIG. 4A. Deformations of the droplet forming unit 3 negatively affect droplet formation due to variations in tensions in a membrane forming a flexible wall of a pressure chamber, thereby affecting a resonance frequency of the droplet ejection system; in particular droplet speed and volume may be affected. Due to differences in droplet speed and volume, image quality is deteriorated. Deviations in droplet speed and angle are therefore preferably avoided and therefore deformations of the droplet forming unit 3 are preferably avoided.

In FIG. 4A (illustrating a quarter of the whole model in cross-section), the intermediate element 4 is provided with support protrusions 44. The support protrusions 44 are arranged below the outer portion 35 of the ink inlet surface 34 of the droplet forming unit 3. So, any mechanical stress between the droplet forming unit 3 on the one hand and the intermediate element 4 and the ink supply substrate 2 on the other hand induced by the thermal expansion is mainly localized at the location of the support protrusions 44. FIGS. 4B and 4C illustrate the mechanical strain in the X-direction ('XX-strain) at three lines along the Y-direction at three different X-positions (X=0.2 mm; X=2.6 m; and X=5.3 mm) as indicated in FIG. 4A.

Relevant to the deformation is the difference in strain at different locations. FIG. 4B shows the simulation results for a droplet forming unit 3 arranged on an intermediate element 4 not having support protrusions 44, but having a solid support ridge instead. The difference in strain between a minimum strain and a maximum strain (in FIG. 4B indicated for X=0.2 mm) is about 11 ppm (minimum is about $-3.35*10^{-5}$; maximum is about $-2.25*10^{-5}$). Table I presents the data for all three curves for both solid ridge (FIG. 4B) and support protrusions (FIG. 4C).

TABLE I

| With support ridge (FIG. 4B) | | | | With support protrusions (FIG. 4C) | | |
|---|---|---|---|---|---|---|
| Min [$10^{-5}$] | Max [$10^{-5}$] | Diff. [$10^{-6}$] | | Min [$10^{-5}$] | Max [$10^{-5}$] | Diff. [$10^{-6}$] |
| −3.35 | −2.25 | 11.0 | X = 0.2 mm | −3.15 | −2.30 | 8.5 |
| −3.35 | −2.35 | 10.0 | X = 2.6 mm | −3.15 | −2.50 | 6.5 |
| −3.44 | −2.45 | 9.9 | X = 5.3 mm | −3.20 | −2.50 | 7.0 |

As apparent from Table I, the differences between the minimum XX-strain and the maximum XX-strain is reduced with about 30%. So, using the protrusions as support for the droplet forming unit 3 reduces deformations in the droplet forming unit 3 due to differences in coefficient of thermal expansion resulting in an improved image quality.

Figure 5:
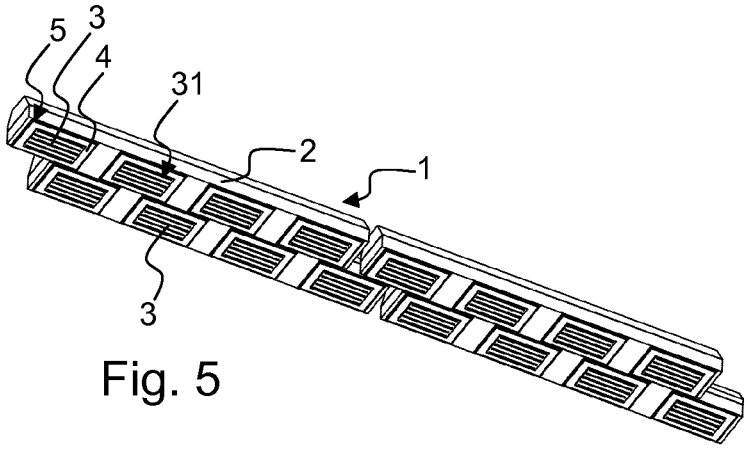
FIG. 5 shows a perspective view of a second embodiment of an inkjet print head.

FIG. 5 illustrates another embodiment, in which a number of droplet forming units 3 are arranged on a single ink supply substrate 2. Each droplet forming unit 3 is arranged on the ink supply substrate 2 with a flexible foil 5 and an intermediate element 4 interposed therebetween. Using suitable staggering of the chips, a virtually continuous row of orifices 31 may be created as is well known in the art. Further, with a suitable design as shown, multiple print heads may be positioned and aligned to create an even longer virtually continuous row.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms “a” or “an”, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be apparent that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet print head for generating a droplet of ink, the inkjet print head comprising:

an ink supply substrate having an ink supply channel in fluid communication with an ink supply connector channel for receiving ink from an ink reservoir and in fluid communication with an ink return connector channel for supplying ink to the ink reservoir;

a droplet forming unit arranged on the ink supply substrate, the droplet forming unit having an ink inlet surface and comprising a number of droplet ejection units, each droplet ejection unit comprising an ink flow path extending between an ink inlet port and an orifice, a piezoelectric actuator being arranged in operative communication with the ink flow path for generating a pressure wave in the ink in the ink flow path, the ink inlet port for receiving ink from the ink supply substrate being arranged in the ink inlet surface;

a manifold chamber formed over the ink inlet surface of the droplet forming unit; and a filter arranged between the ink supply substrate and droplet forming unit, the filter having a first filter surface at an upstream side and a second filter surface at a downstream side, the second filter surface being opposite to the first filter surface and filter holes extending from the first filter surface to the second filter surface;

wherein the first filter surface forms a wall of the ink supply channel.

2. The inkjet print head according to claim 1, wherein a manifold supply channel is provided surrounding the manifold chamber for supplying ink to the manifold chamber, the second filter surface forming a wall of the manifold supply channel.

3. The inkjet print head according to claim 2, wherein the manifold supply channel is formed in an intermediate element, the intermediate element being arranged between the ink supply substrate and the droplet forming unit.

4. The inkjet print head according to claim 3, wherein the intermediate element is provided with an ink supply opening and the ink supply opening forms the manifold chamber.

5. The inkjet print head according to claim 3, wherein the intermediate element is provided with support protrusions at a circumference of the manifold supply channel, a fluid connection between the manifold chamber and the manifold supply channel being formed by at least one manifold feed opening arranged between the support protrusions.

6. The inkjet print head according to claim 1, wherein the manifold chamber has a flexible wall arranged opposite to the ink inlet surface of the droplet forming unit, the flexible wall being formed by a flexible foil.

7. The inkjet print head according to claim 6, wherein a manifold supply channel is provided surrounding the manifold chamber for supplying ink to the manifold chamber, the second filter surface forming a wall of the manifold supply channel;

wherein the flexible foil extends over the manifold supply channel; and wherein the flexible foil is provided with filter holes in an area arranged over the manifold supply channel, the flexible foil thereby forming the filter.

8. The inkjet print head according to claim 6, wherein the distance between the droplet forming unit and the flexible wall is smaller than 1 mm.

9. The inkjet print head according to claim 1, wherein the filter comprises a number of filter holes in a filter area, each filter hole having a filter hole area and the filter having a cumulative filter hole area equaling the filter hole area times the number of filter holes;

a ratio of the cumulative filter hole area over the filter area being selected such that a flow of ink in the ink supply channel in a direction parallel to the first filter surface generates a parallel ink flow in the ink at the second filter surface.

10. The inkjet print head according to claim 9, wherein said ratio is at least 15%.

11. The inkjet print head according to claim 6, wherein the distance between the droplet forming unit and the flexible wall is smaller than 500 micron.

12. The inkjet print head according to claim 6, wherein the distance between the droplet forming unit and the flexible wall is smaller than 400 micron.

13. The inkjet print head according to claim 9, wherein said ratio is at least 20%.

14. The inkjet print head according to claim 9, wherein said ratio is at least 30%.

* * * * *